US010976029B1

(12) United States Patent
Jordan

(10) Patent No.: US 10,976,029 B1
(45) Date of Patent: Apr. 13, 2021

(54) CHANDELIER HAVING SELECTIVELY MOTORIZED ORNAMENTS

(71) Applicant: Louis Jordan, Miramar, FL (US)

(72) Inventor: Louis Jordan, Miramar, FL (US)

( * ) Notice: Subject to any disclaimer, the term of this patent is extended or adjusted under 35 U.S.C. 154(b) by 0 days.

(21) Appl. No.: 16/664,115

(22) Filed: Oct. 25, 2019

Related U.S. Application Data

(60) Provisional application No. 62/756,651, filed on Nov. 7, 2018.

(51) Int. Cl.

| | |
|---|---|
| ***F21V 14/06*** | (2006.01) |
| ***F21V 5/06*** | (2006.01) |
| *F21S 8/06* | (2006.01) |
| *F21V 21/34* | (2006.01) |
| *F21V 14/02* | (2006.01) |

(52) U.S. Cl.
CPC ..... *F21V 14/06* (2013.01); *F21V 5/06* (2013.01); *F21S 8/065* (2013.01); *F21V 14/02* (2013.01); *F21V 21/34* (2013.01)

(58) Field of Classification Search
CPC . F21V 14/02; F21V 14/06; F21V 5/06; F21V 5/10; F21V 21/008; F21V 21/034; F21L 15/02; F21S 8/065
See application file for complete search history.

(56) References Cited

U.S. PATENT DOCUMENTS

| | | | | |
|---|---|---|---|---|
| 1,032,660 | A * | 7/1912 | Czerny | F21V 19/008 362/382 |
| 2013/0135870 | A1* | 5/2013 | Yokosawa | F21S 6/008 362/253 |
| 2017/0370537 | A1* | 12/2017 | Wu | F21V 17/02 |
| 2018/0274769 | A1* | 9/2018 | Vavruskova | F21V 14/00 |

* cited by examiner

*Primary Examiner* — Rajarshi Chakraborty
*Assistant Examiner* — Nathaniel J Lee
(74) *Attorney, Agent, or Firm* — John Rizvi; John Rizvi, P.A.—The Patent Professor®

(57) ABSTRACT

A chandelier having selectively motorized ornaments. Inner ornaments are selectively motionable laterally along their individual slide tracks by motorized push structures above the inner ornaments. The push structures are longitudinally and laterally translatable. Outer ornaments slidably engage ends of the chandelier. Sliding the outer ornaments causes the slide tracks to collectively open or close. A side push surface may laterally translate to push the inner ornaments into a straight line. The inner ornaments may adopt a plurality of patterns because their positions are manipulable by the push structures, the push surface, and the sliding outer ornaments.

18 Claims, 24 Drawing Sheets

CHANDELIER HAVING SELECTIVELY MOTORIZED ORNAMENTS

CROSS-REFERENCE TO RELATED APPLICATION

This application claims the benefit of U.S. Provisional Patent Application Ser. No. 62/756,651, filed Nov. 7, 2018, which is incorporated herein in its entirety.

FIELD OF THE INVENTION

The present invention relates generally to motorized ceiling fixtures, and more particularly to a chandelier having selectively motorized ornaments.

BACKGROUND OF THE INVENTION

It is common for individuals to install various ceiling fixtures in their homes or businesses. For example, an individual may desire to install a ceiling fan for keeping a room cool and delivering air convection. As another example, an individual may desire to install a light fixture to illuminate a room. In general, individuals desire ceiling fixtures that are concurrently aesthetically pleasing and functional. For example, an individual may enjoy the look of a ceiling fan that has an aerodynamic appearance while having other functional features such as lights.

A common functional and decorative ceiling item is a chandelier. Chandeliers are generally configured to deliver an aesthetically pleasing ambient light, while also adding style and beauty to a room through the fixture itself. For example, a chandelier, sometimes referred to as a girandole or candelabra lamp, may be a light fixture having branched ornamental lights mounted on ceilings or less commonly on walls. Chandeliers may conventionally use incandescent light bulbs. Modern chandeliers may have LEDs or fluorescent lamps.

Chandeliers may a have a plurality of crystals or refractive elements, hanging in arrays, to illuminate a vicinity in which the chandelier is installed, which is most commonly a room. For example, a traditional chandelier may include one or more prisms that are configured to refract incident light from a light source into beautiful ambient light. Chandeliers may include mirrors, prisms, or other refractive elements to fill a room with refracted or reflected light, which many believe is a beautiful effect.

However, people may consider existing chandeliers to be boring and may desire a chandelier that caters to modern expectations and style.

Therefore, there exist a need for a chandelier that is exciting and beautiful to look at while maintaining modern feel and functionality.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

Disclosed is, a chandelier, the chandelier comprising:

a lower frame and an upper frame;

a first side and a second side opposite from each other:

a third side and a fourth side opposite from each other and adjacent the first side and second side;

a first outer ornament attached on the third side;

a second outer ornament attached on the fourth side;

wherein the first outer ornament and the second outer ornament selectively slide along the third side and fourth side respectively; and a plurality of inner ornaments attached within the sides of the lower frame, such that the plurality of inner ornaments selectively displace within the sides of the lower frame.

In another aspect, the chandelier further comprises:

a push arm slidably attached between the third side and the fourth side to cause the inner ornaments to selectively displace.

In another aspect, the push arm includes intermittently arranged downwardly oriented push structures configured to push some of the plurality of inner ornaments when the push arm slides.

In another aspect, the push structures are configured to push some of the inner ornaments to create a pattern using the inner ornaments.

In another aspect, each inner ornament is slidably attached to an inner ornament slide track.

In another aspect, the inner ornament slide track telescopes.

In another aspect, the inner ornament slide tracks are attached to an inner ornament arm extending between the third side and the fourth side.

In another aspect, the inner ornament arm is configured to slide along the third side and fourth side.

In another aspect, sliding the inner ornament arm causes the inner ornament slide tracks to extend and retract.

In another aspect, sliding the first outer ornament and second outer ornament causes the inner ornament arm to slide.

In another aspect, the upper frame includes a push surface extending along the second side configured for pushing all of the inner ornaments into a straight line.

In another aspect, the push arm is configured to displace longitudinally to adjust alignment between the push structures and the inner ornaments, such that different inner ornaments are pushable to create various patterns.

In another aspect, the push arm is fixed to the upper frame, and the upper frame and the push arm slide together to cause the inner ornaments to be selectively pushed.

In another aspect, the chandelier includes one or more lights.

In another aspect, the chandelier includes one or more mirrors.

In another aspect, motors are included to cause the outer ornaments to slide.

In another aspect, motors are included to cause the push arm and/or the upper frame to slide laterally.

In another aspect, motors are included to cause the push arm to slide longitudinally.

In another aspect, a computer is included to instruct the motors to cause the outer ornaments, the upper frame, and the push arm to slide.

In another aspect, the chandelier further comprises, a hanging support attachable to a ceiling for suspending the chandelier.

In another aspect, the chandelier includes one or more LED lights within a frame of the chandelier to provide a modern lighting effect.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
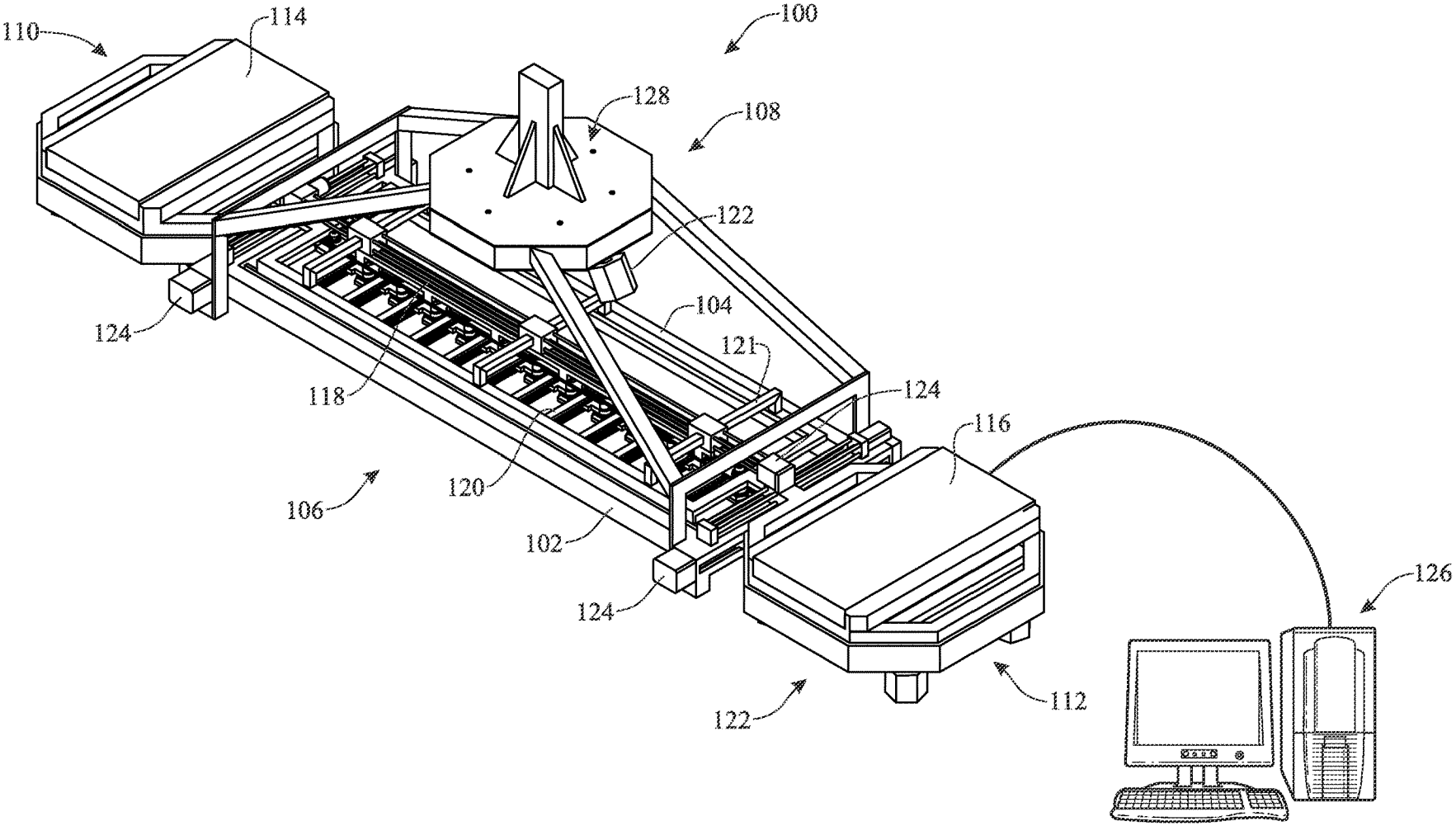
FIG. 1 presents a top perspective view of a chandelier, in accordance with aspects of the present disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Disclosed herein is a chandelier configured to move inner ornaments to create patterns. The chandelier may be called "The Matrix Chandelier", and may simulate the motion of a drone in-flight while hanging from a ceiling.

The inner ornaments may be crystals, or any appropriate light refracting ornament. It is to be understood that the ornaments described herein may be any appropriate ornament without departing from the spirit and scope of this disclosure, such as mirrors, glass ornaments, opaque ornaments, and/or hanging ornaments, and lights, as non-limiting examples. Although the ornaments described below are shown in the figures placed in specific locations, it is to be understood that these positions of the ornaments are shown merely as examples and are not intended to limit the scope of this disclosure. Therefore, the ornaments may be placed on any appropriate location on the chandelier. Upon being moved by the below disclosed structures, the ornaments may hold any appropriate pattern relative to one another, as desired by a user controlling the various disclosed mechanisms. Further, lights may be located on any appropriate portion of the chandelier. The chandelier may generally resemble a modern drone in flight. The chandelier may have mirrored surfaces. The chandelier may cause inner ornaments to hold any number of patterns, such as 1, 2, 3, 4, or more patterns, without departing from the spirit and scope of this disclosure.

As shown throughout the figures, a chandelier 100 may include a lower frame 102 and an upper frame 104, a first side 106 and a second side 108 opposite from each other (i.e. the first side 106 may be opposite the second side 108), a third side 110 and a fourth side 112 opposite from each other (i.e. the third side 110 and the fourth side 112 may be opposite each other) and adjacent the first side 106 and second side 108, a first outer ornament 114 attached on the third side 110, and a second outer ornament 116 attached on the fourth side 112.

The first outer ornament 114 and the second outer ornament 116 may selectively slide along the third side 110 and fourth side 112 respectively. The chandelier 100 may further include a plurality of inner ornaments 410 attached within sides of the lower frame 102, such that the plurality of inner ornaments 410 selectively displace within the sides of the lower frame 102.

It is to be understood that LED lights may be placed at any appropriate location on the device to illuminate the crystals, for example both inside and outside of the frame 102. The LED lights may circle inner portions of the octagons, and the lights may be turned on or off and configured for whatever color the user wishes. For example, the color of the lights may be adjusted using a smart phone.

The chandelier 100 may further include a push arm 118 slidably attached between the third side 110 and the fourth side 112 to cause the inner ornaments 410 to selectively displace when the push arm 118 slides along the third side 110 and the fourth side 112. The push arm 118 may include intermittently arranged downwardly oriented push structures 402 configured to push some, and not all, of the plurality of inner ornaments 410 when the push arm 118 slides. For example, the push structures 402 may be configured to push some of the inner ornaments 410 to create a pattern using the inner ornaments 410. It is to be understood that the number of push structures 402 may be 7, and the push structures may be placed in a particular order and have a particular spacing to achieve certain patterns of the crystals.

Each inner ornament 410 may be slidably attached to an inner ornament slide track 120. The inner ornament slide track 120 may telescope. All inner ornament slide tracks 120 may be attached to an inner ornament arm 502 extending between the third side 110 and the fourth side 112. There may be a total of 13 inner ornaments 410 and 13 corresponding individual inner ornament slide tracks 120. Additionally, one slide track may be located on each end of the device for the outer ornaments to slide in (e.g. via a connector 3102). The slide tracks 120 may each have two portions, such that a distal portion slides on a proximal portion that is attached to the lower frame, and the distal portion may have a channel 408' (FIG. 3) configured to receive one of the inner ornaments 410 such that the inner ornament 410 slides in the channel 408', and the distal portion slides on the proximal portion. When an inner ornament 410 reached an end of the channel 408', depending on which end it reaches, movement of the inner ornament 410 may either extend or retract the respective slide 120 by applying a net force to the distal portion of the slide 120. The end slides 1302 also act this way such that a motion of the outer ornaments may cause the distal portion of the slides 1302 to extend or retract with continued motion at either end of the channel 408' of the end slides 1302.

It is to be understood that the number of crystal slide tracks that should be used with the invention could be uneven. For example, 9, 11, 13, 15, 17, 19, or 21 slide tracks could be included. For example if 13 crystal slide tracks are used, 7 push blocks would be required. If 15 crystal slide tracks are used there would be 8 push blocks needed. If 17 crystal slide tracks are needed 9 push blocks would be needed. For 11 crystals, 6 push blocks are needed. For 13 crystals, 7 push blocks are needed. For 15 crystals, 8 push blocks are needed. For 17 crystals, 9 push blocks are needed. For 19 crystals, 10 push blocks are needed. For 21 crystals, 11 push blocks are needed.

The inner ornament arm 502 may be configured to slide along the third side 110 and fourth side 112 concurrently. Sliding the inner ornament arm 502 may cause the inner ornament slide tracks 120 to extend and retract according to a direction the inner ornament arm 502 slides, since the inner ornament arm 502 is attached to the distal portion of the slide tracks 120 to cause the slide tracks to extend and retract all together.

Figure 4:
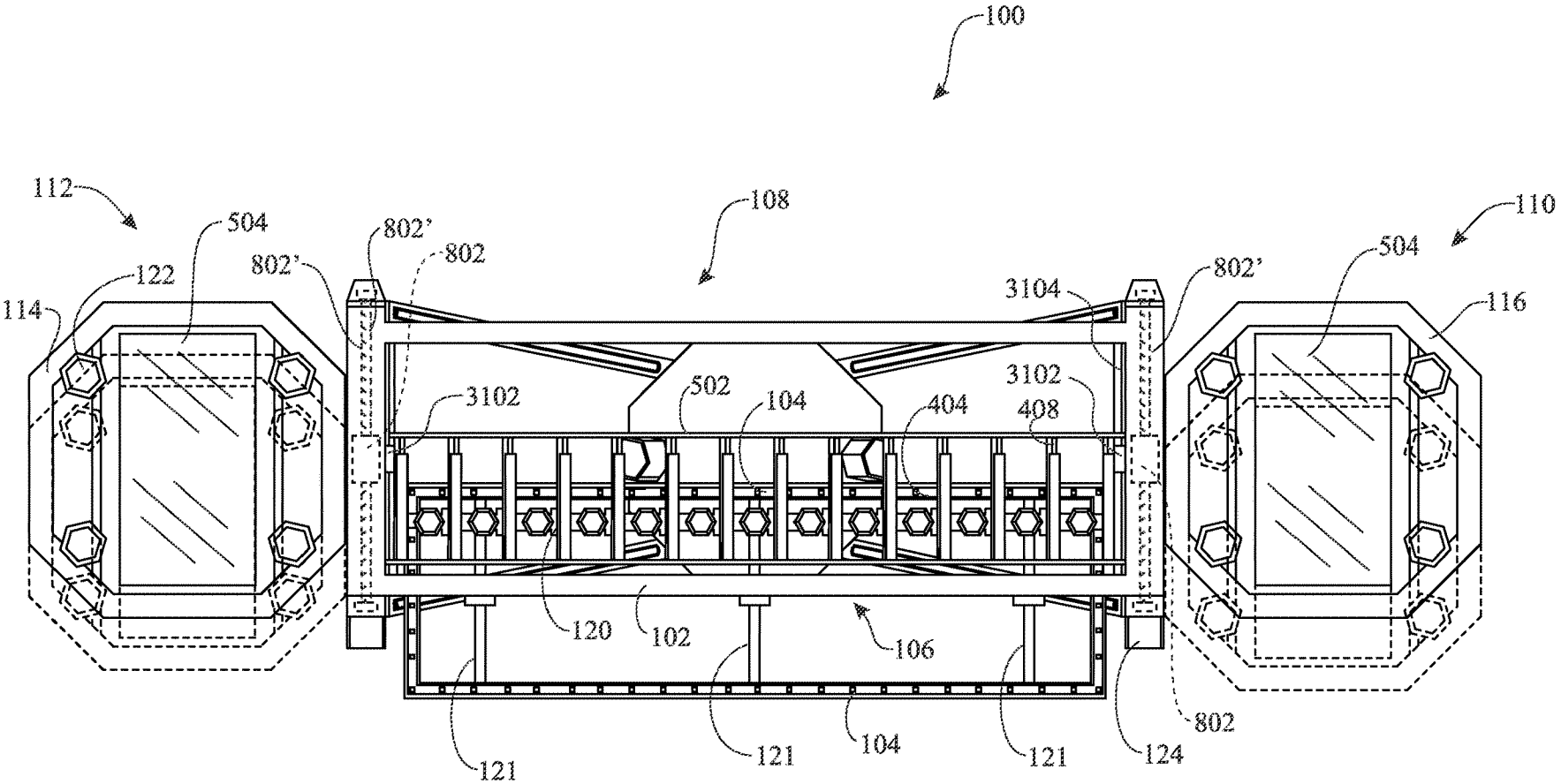
FIGS. 4-6 present a motion sequence of a bottom view of the chandelier, in accordance with aspects of the present disclosure.
Figure 5:
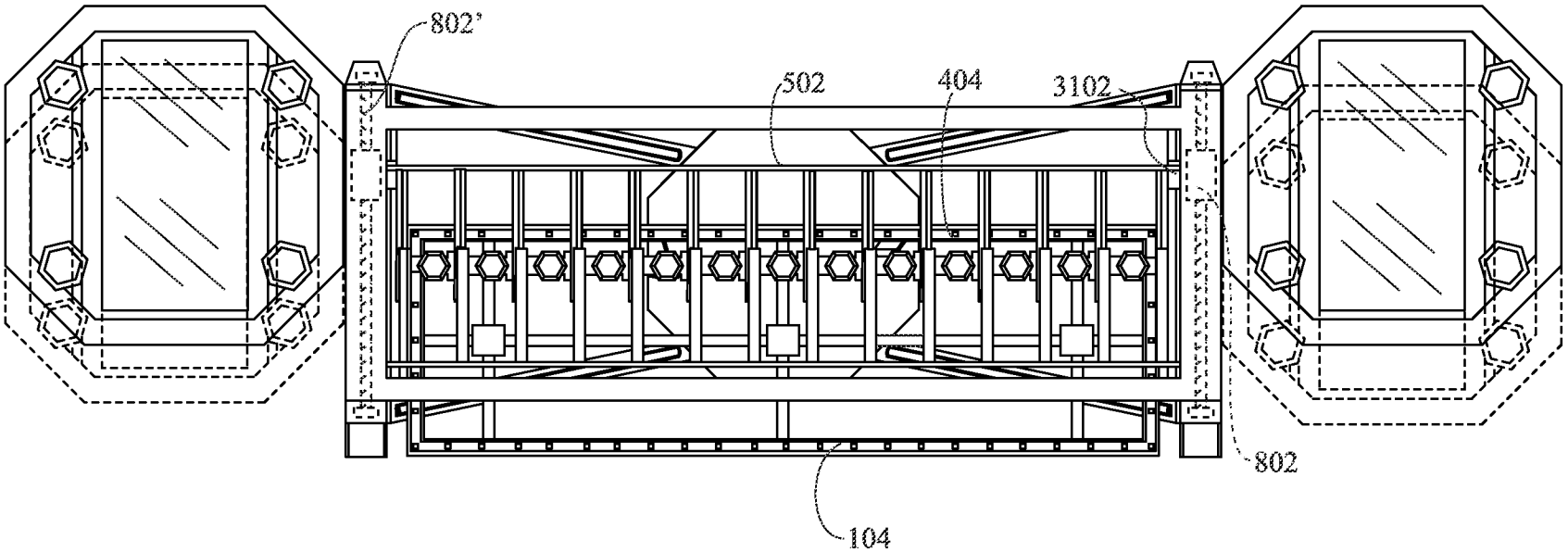
Figure 6:
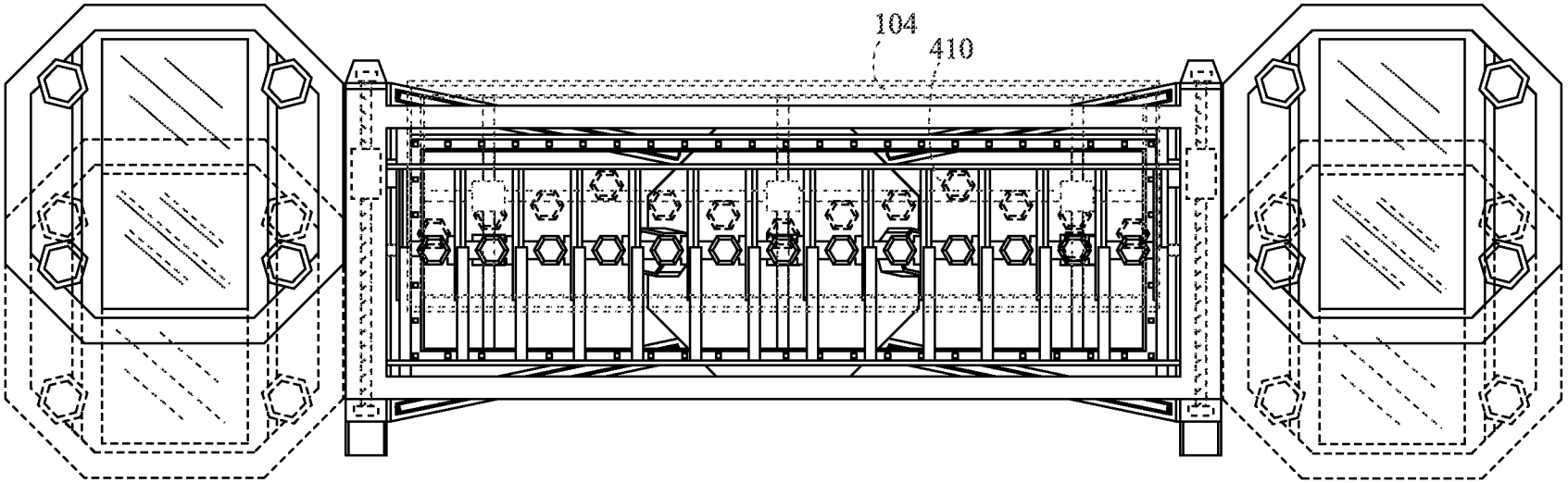
Figure 7:
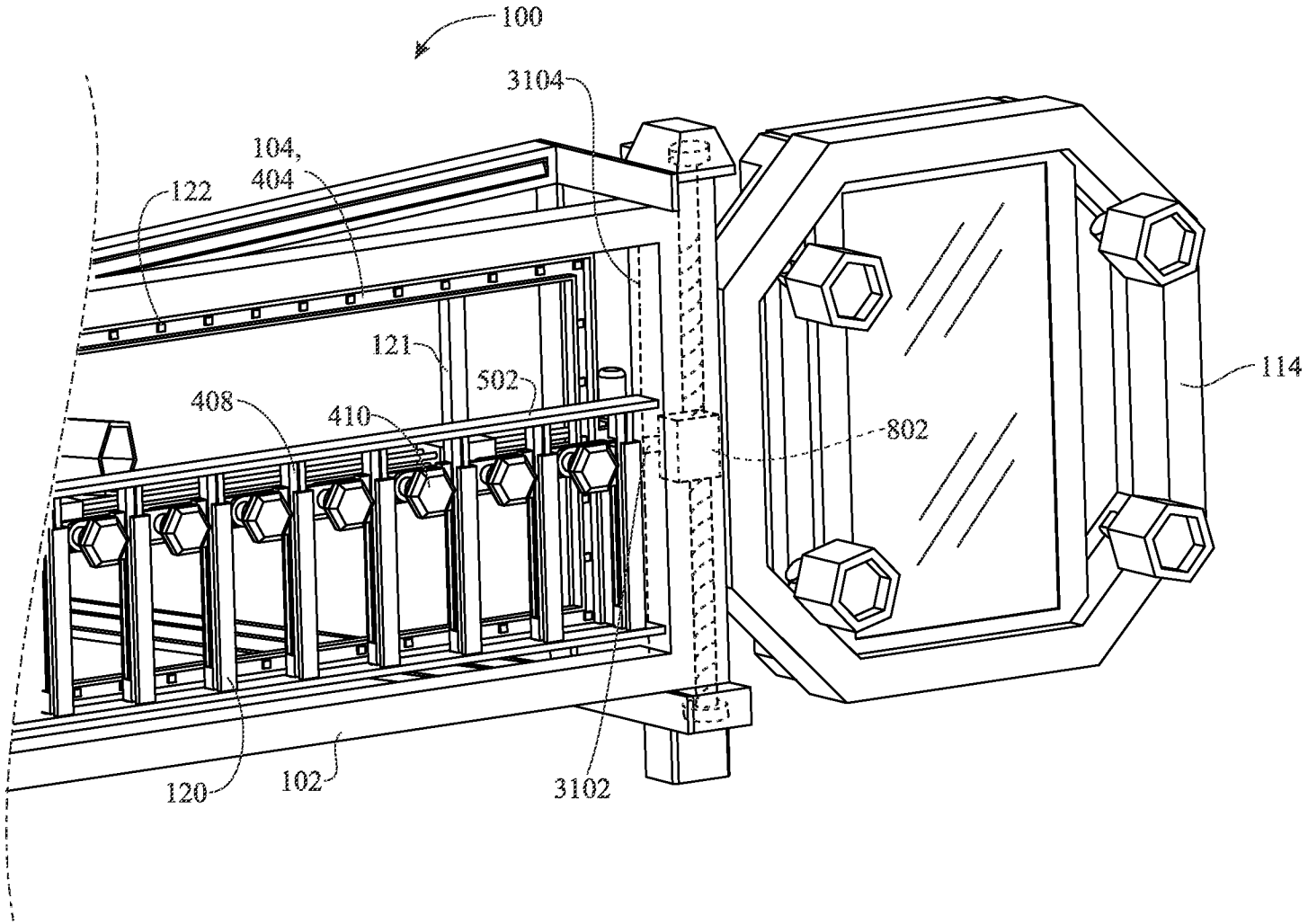
FIG. 7 presents a bottom perspective view of the inner ornaments in a straight line, and their slide tracks having been retracted, in accordance with aspects of the present disclosure.
Figure 12:
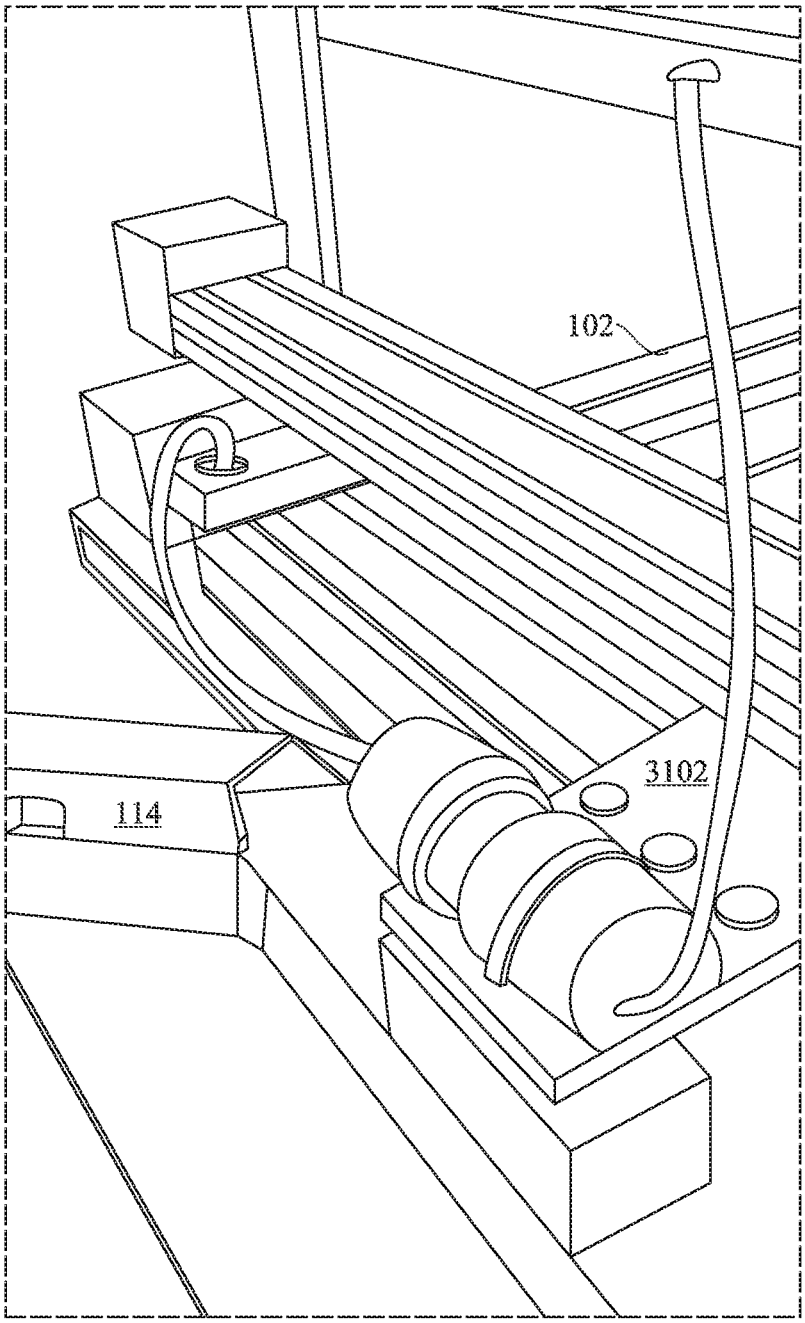
FIG. 12 shows a top perspective view of an outer ornament attachment and a corresponding lead screw, in accordance with aspects of the present disclosure.
Figure 13:
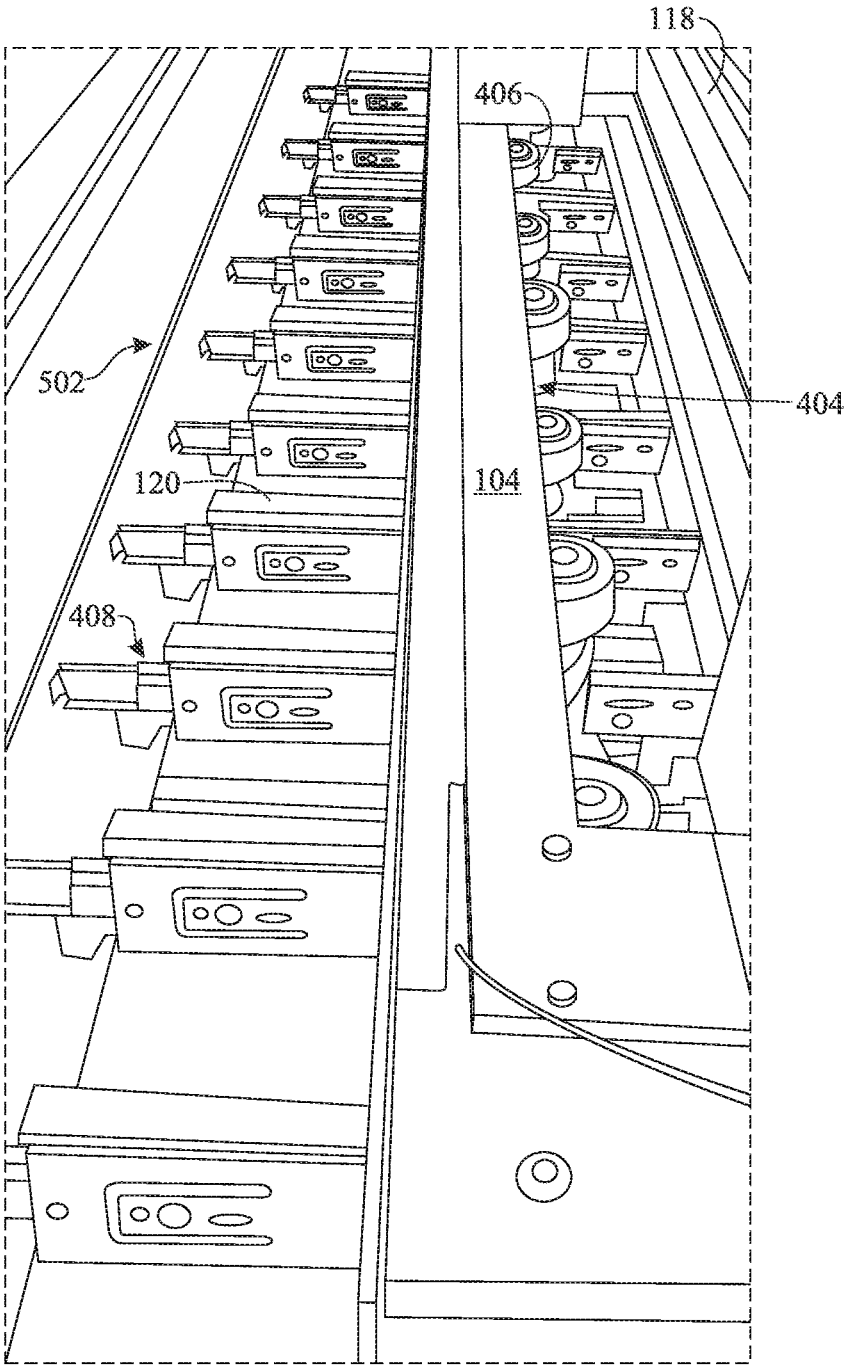
FIG. 13 shows a top perspective view of an inner ornament arm in a non-extended position, an upper frame, and a longitudinal slide belt for the push arm, in accordance with aspects of the present disclosure.
Figure 14:
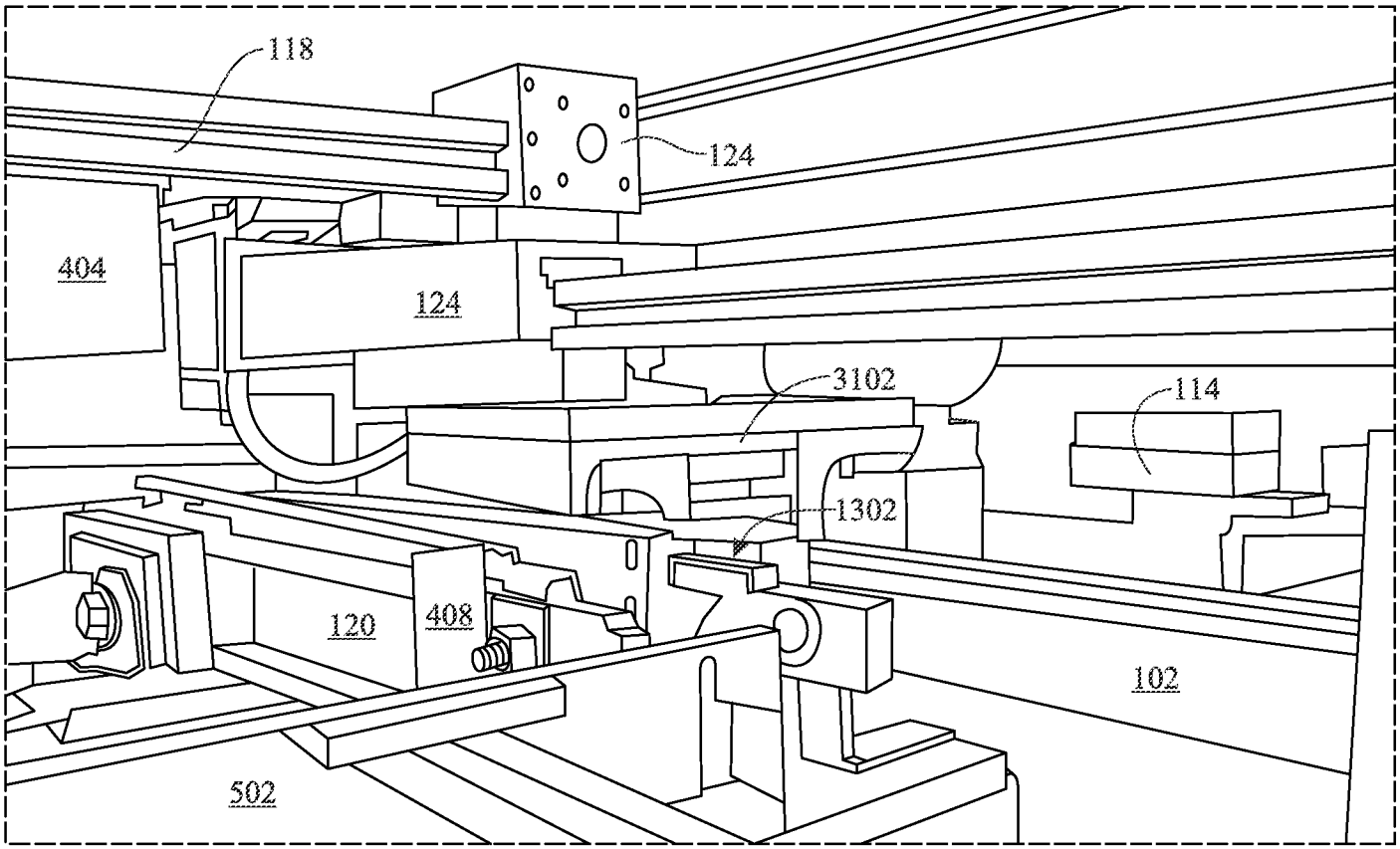
FIG. 14 shows an inner corner of the chandelier, in accordance with aspects of the present disclosure.

Sliding the first outer ornament 114 and second outer ornament 116 may cause the inner ornament arm 502 to slide. For example, as shown in FIG. 14 the outer ornament 114 may be connected to an end slide 1302 by the connector 3102. The end slide 1302 may have the same features of the inner slide tracks 120. As shown in FIGS. 12 and 14, the outer ornament 114 is slidably attached to the end slide 1302 via outer ornament connector 3102, as a non-limiting example. In FIG. 4, the outer ornaments 114 may move along a channel 408' in the slide 1302 without actually telescoping the slide 1302 or telescoping any of the slides 120 or displacing the inner ornament arm 502, by not applying a net force to a sliding distal portion of the slides 120. This is because the outer ornaments slide within a channel 408' in the slide 1302 via the connector 3102. When the outer ornament causes the connector 3102 (FIG. 14) to reach an end of a channel 408' within the slide 1302 (a channel 408' is seen in FIG. 14 within slide portion 408) the end slide 1302 starts to telescope outward (extend) and extend outward causing the outer ornament arm 502 to extend and all of the inner slides 120 to also extend, as shown in FIG. 5. Once the slide 1302 is extended, the outer ornaments may move back and forth while the connector 3102 remains within the channel 408' of the slide 1302 without causing any other component to move as shown in FIG. 6. Similarly as the outer ornaments reach the end of a channel 408' in the slide 1302 in the opposite direction as described above with respect to FIG. 4, the inner slides will start retracting because the outer slides 1302 will start retracting and thus cause the inner arm 502 to start displacing.

The upper frame 104 may include a push surface 404 extending along the second side 108 configured for pushing all of the inner ornaments 410 into a straight line. This can be seen in FIG. 11. Since this push surface 404 extends downwardly past upper push points of the inner ornaments, between FIGS. 4 and 5 it is shown that the upper frame 104 has to move along with the crystals (inner ornaments), as the crystals are motioned together due to the inner ornament arm 502 extending the inner slides 120. In other words, the lip of the push surface 404 would naturally block the upper points of the inner ornaments, so therefore the push surface 404 would need to also translate as the inner ornaments translate, especially if the inner ornaments are at the end of the channels 408' in their respective slides as they would not be able to move past the end of the channels 408' and without moving the push surface 404 with the inner ornaments the device could become damaged.

Figure 2:
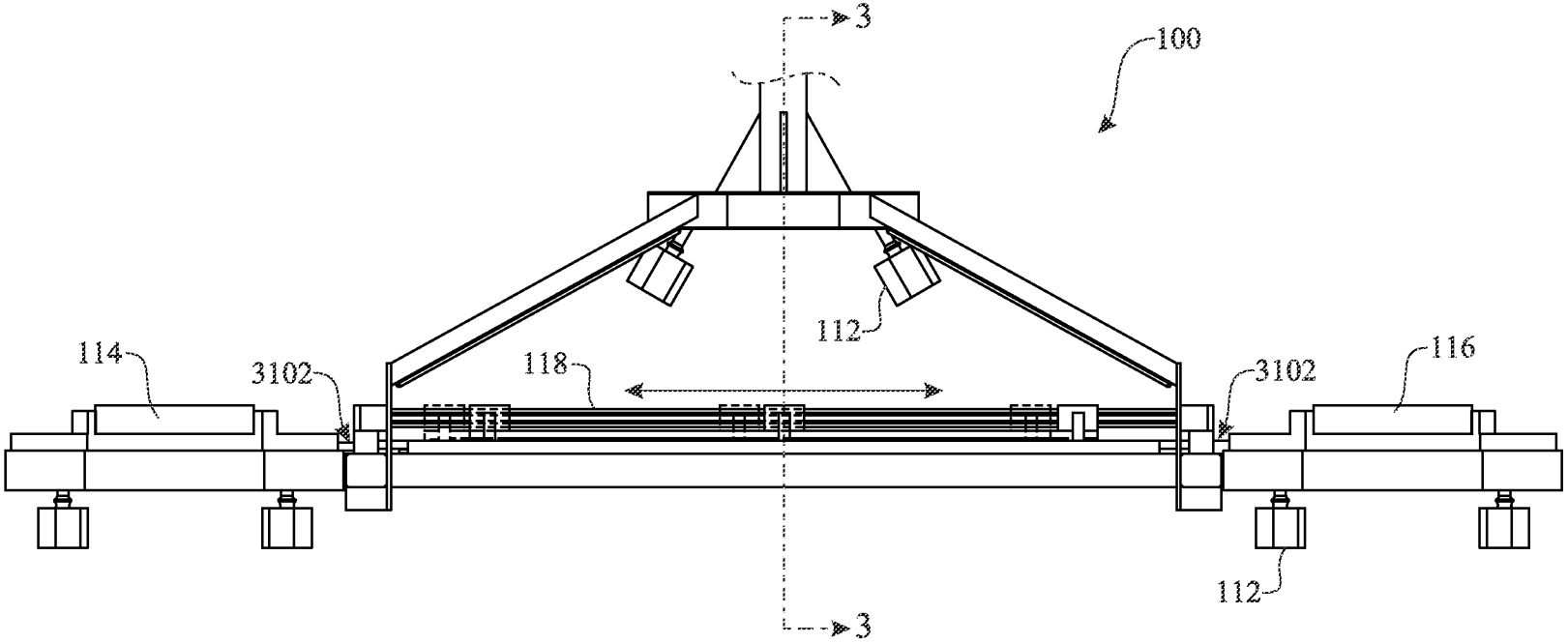
FIG. 2 presents a side elevation view of the chandelier, where an upper arm is shown moving longitudinally, in accordance with aspects of the present disclosure.

The push arm 118 may be configured to displace longitudinally (FIG. 2) to adjust alignment between the push structures 402 and the inner ornaments 410, such that different inner ornaments 410 are pushable to create various patterns. The push arm 118 may be laterally fixed to the upper frame 104, and the upper frame 104 and the push arm 118 may laterally slide together to cause the inner ornaments 410 to be selectively pushed to create patterns of the inner ornaments 410. For example, the push arm 118 may be laterally fixed in between the first side 106 and the second side 108 of the upper frame via lateral crossbars 121, as shown in FIG. 1. Although laterally fixed to the upper frame, the push arm 118 may longitudinally translate in between the crossbars 121, or any intermediate structure, as shown in the figures. Translating the push arm 118 longitudinally allows the push structures 402 to align with different push points 406 of the inner ornaments, and misalign certain push structures 402 with certain push points 406 to selectively push one or more inner ornaments 410 laterally along their inner ornament slide tracks 120 to create a pattern. The inner ornaments slide freely within channels of the inner ornament slide tracks 120, and when they reach ends of their respective channels the inner ornament slide tracks 120 may extend or retract depending on which end of the channels are being pushed by the inner ornaments.

Figure 21:
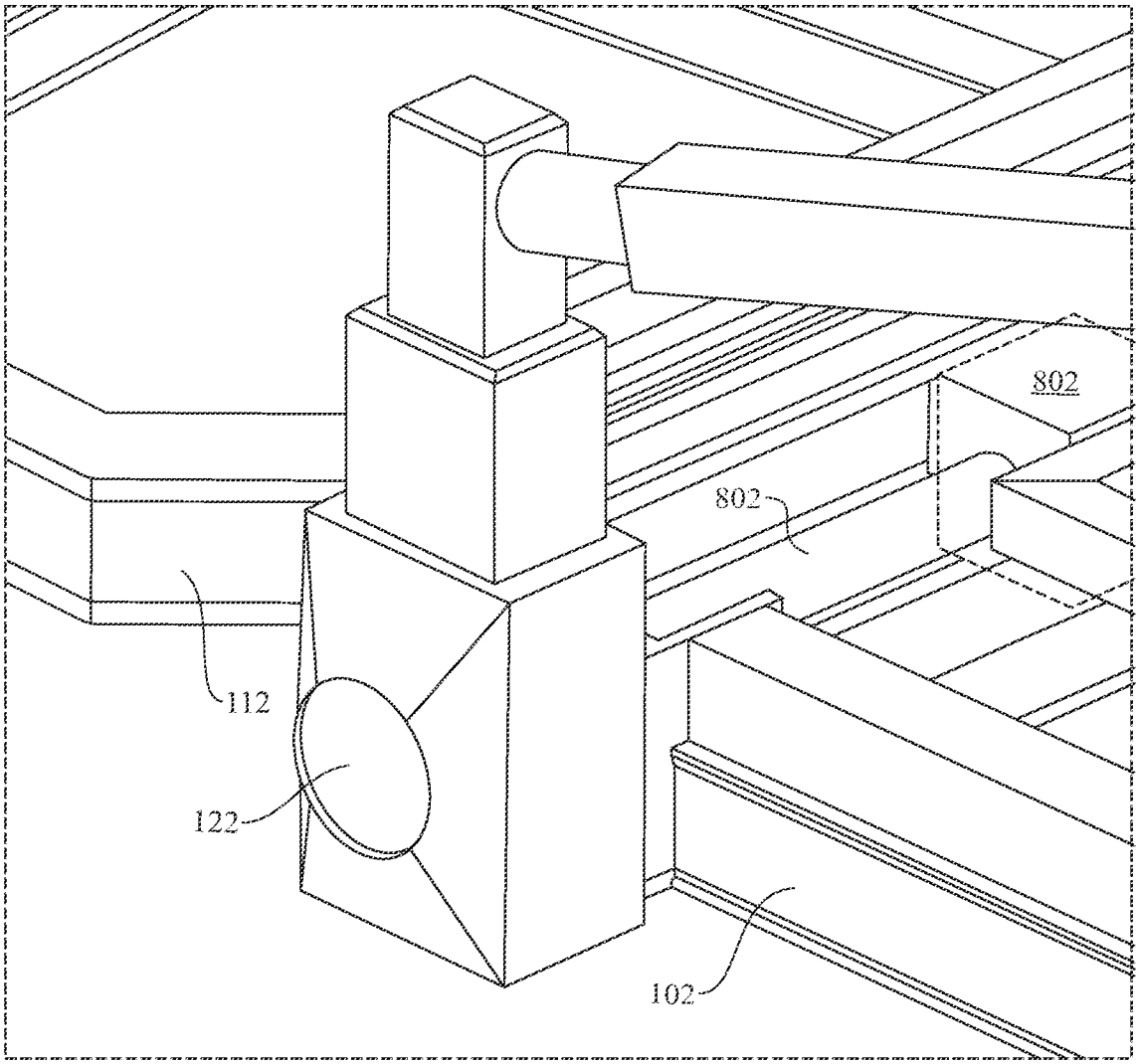

The chandelier 100 may include one or more lights 122. The chandelier 100 may include one or more mirrors 504. For example, FIG. 21 shows headlights 122.

Motors 124 may be included to cause the outer ornaments 114 and 116 to slide. For example, a motor 124 may cause a lead screw 802' to rotate which subsequently causes a lead screw block to translate, and since the lead screw block is attached to the outer ornament 114, the motor causes the outer ornament to also translate. The same configuration may apply to outer ornament 116. Further, motors 124 may be included to cause the push arm 118 and/or the upper frame 104 to slide laterally. Motors 124 may be included to cause the push arm 118 to slide longitudinally (e.g. via a belt 2902). A computer 126 may be included to instruct the motors 124 to cause the outer ornaments 114 and 116, the upper frame 104, and the push arm 118 to slide in any direction and/or in any way described herein or in any reasonable way (e.g. via lead screws 802' or belts). It is to be understood that the computer 126 may be located at any appropriate part of the chandelier, and may be covered by a housing for instance. The computer 126 may be or include a Printed Circuit Board circuit, for example.

Figure 15:
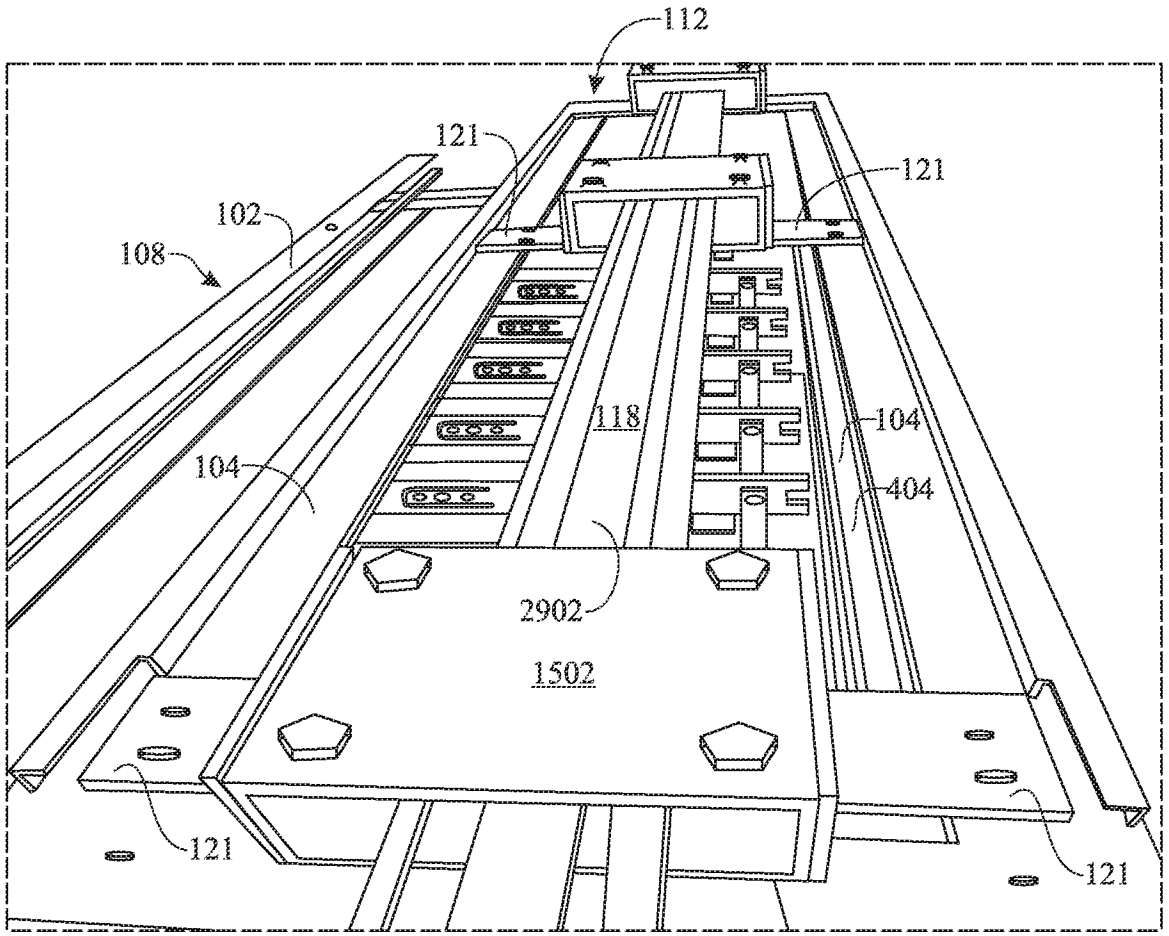
FIG. 15 shows a top perspective view of the push arm, in accordance with aspects of the present disclosure.
Figure 16:
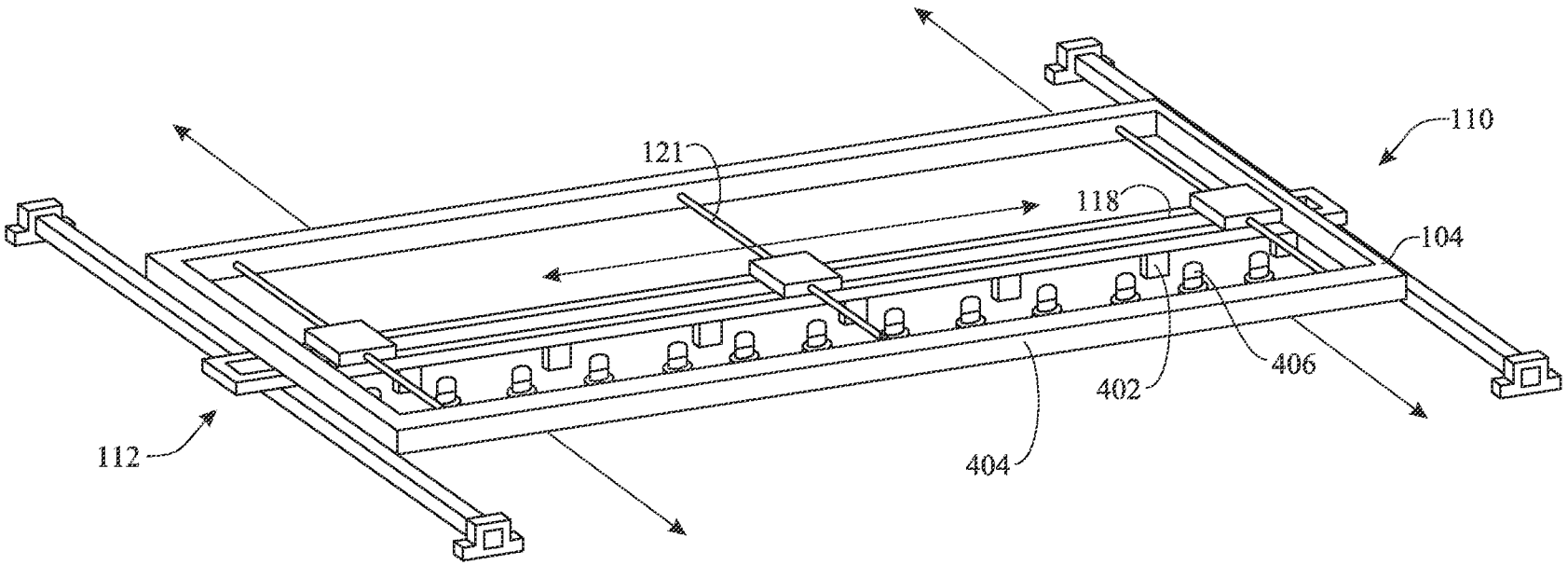
FIG. 16 schematically shows an isolated perspective view of a push arm and its attachment to a frame, and exemplary locations of push points of the inner ornaments, in accordance with aspects of the present disclosure.

Furthermore, as shown in FIG. 15, there is a square box 1502 bolted to an upper part of the structure 121, or the upper frame, the square box 1502 supporting or holding the structure 121 or upper frame in place. In FIG. 15, the belt 118 passes through the square box freely.

The chandelier 100 may further include a hanging support 128 attachable to a ceiling for suspending the chandelier 100.

Figure 8:
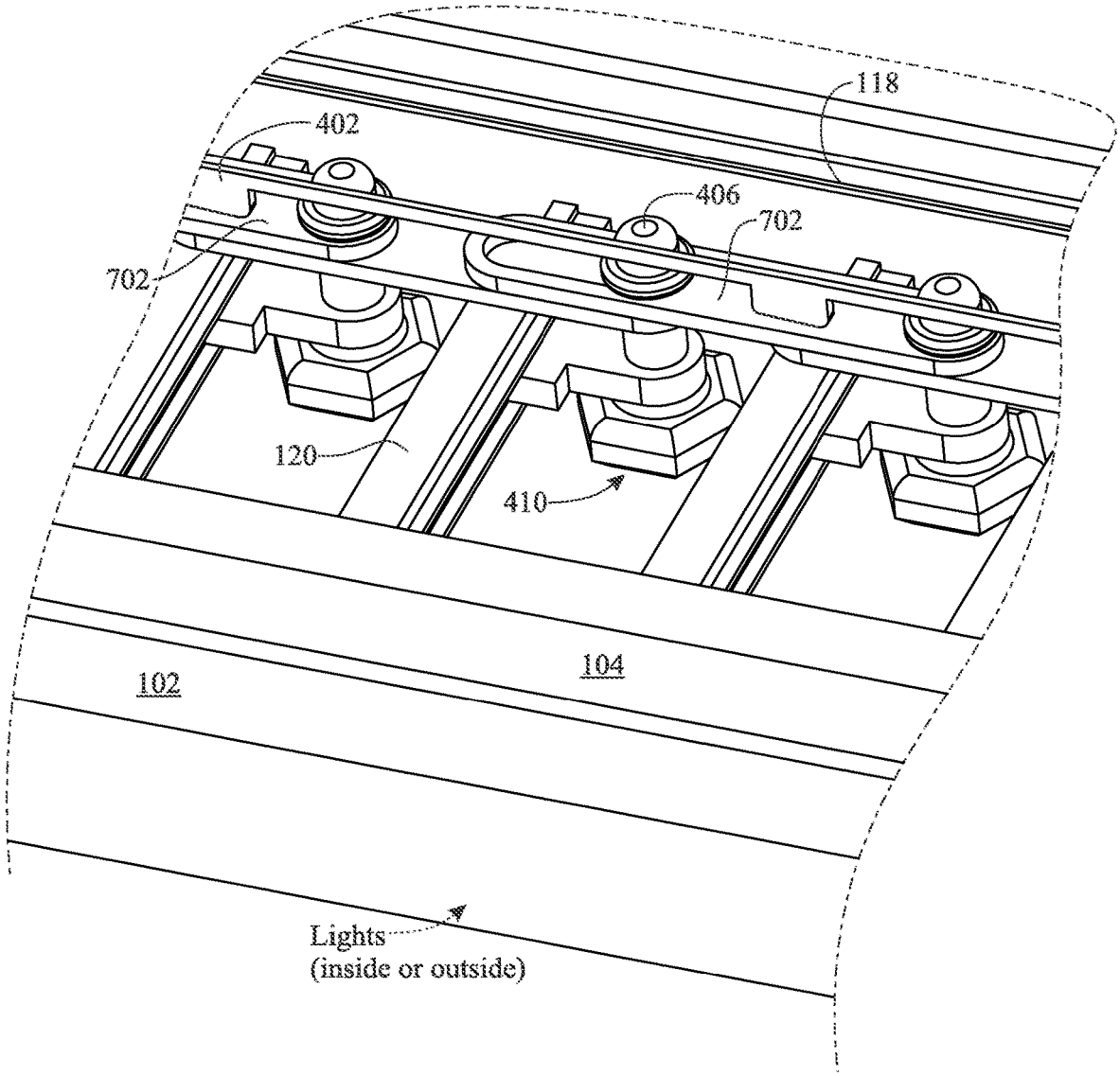
FIG. 8 presents a top perspective view of inner ornaments and their slide tracks, and how push structures of an upper portion are configured to push the inner ornaments into a pattern, in accordance with aspects of the present disclosure.
Figure 9:
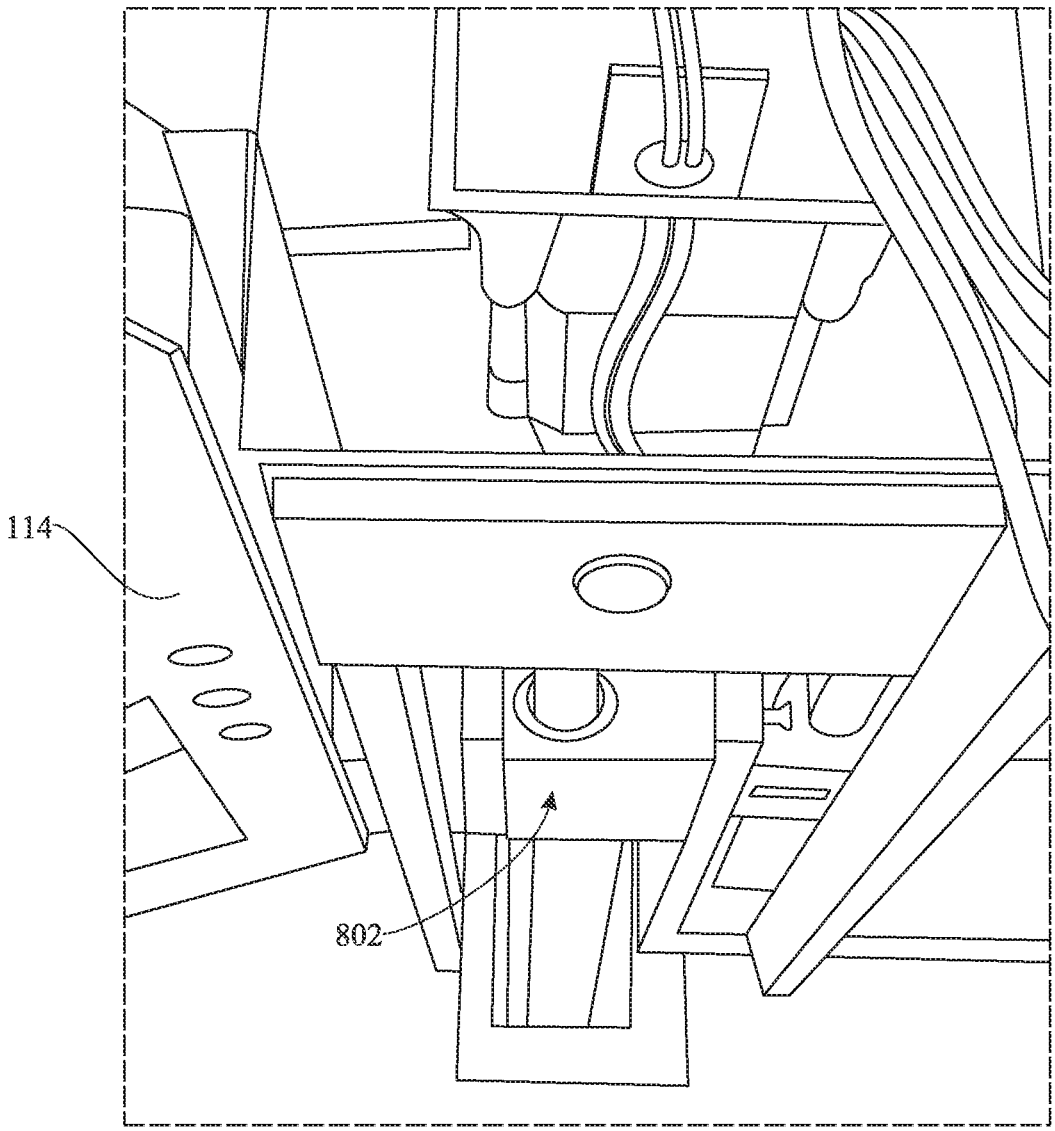
FIG. 9 shows a bottom perspective view of a lead screw motor, in accordance with aspects of the present disclosure.
Figure 10:
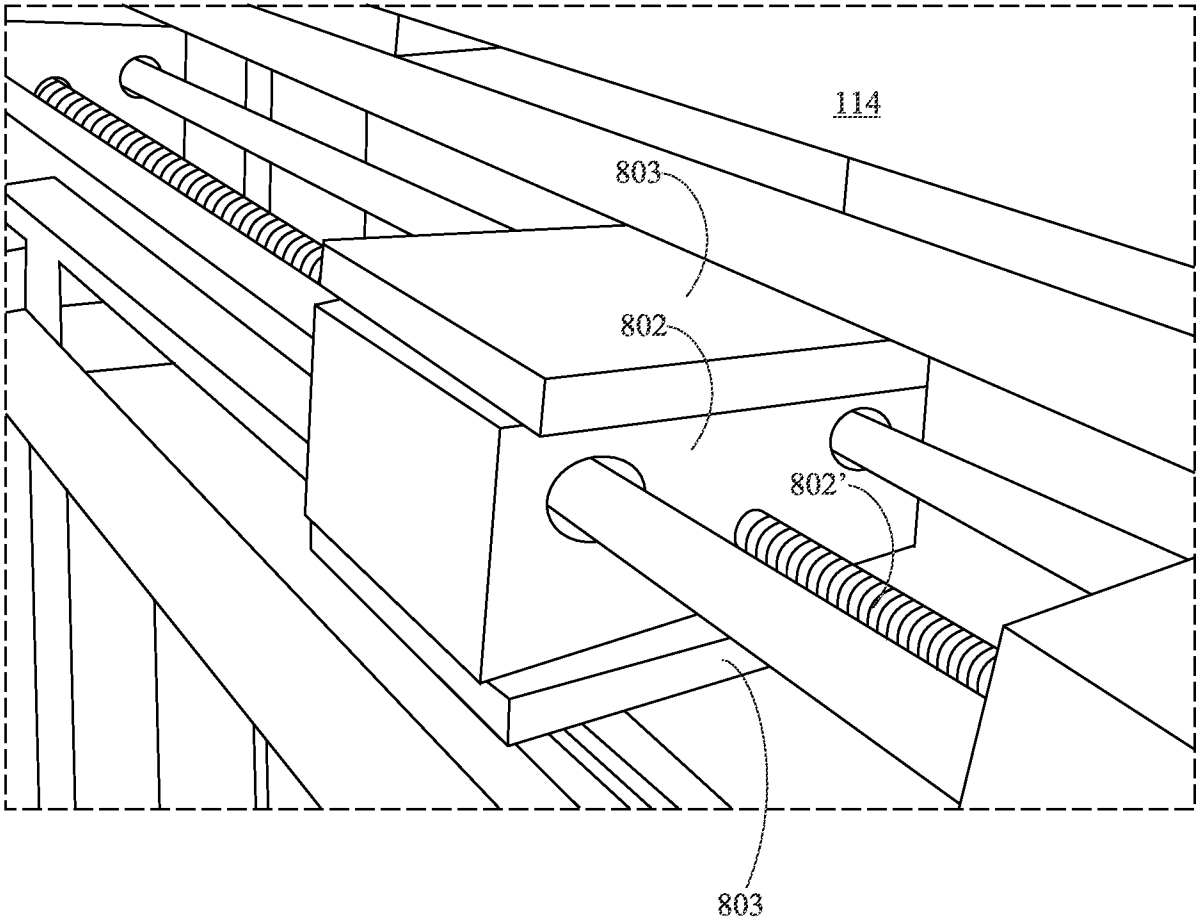
FIG. 10 shows a side bottom perspective view of the lead screw motor and a corresponding lead screw, in accordance with aspects of the present disclosure.

More particularly, the illustration of FIG. 1 presents a top perspective view of the chandelier 100. The outer ornaments 114 and 116 resemble octagons, and have mirrors underneath as shown in FIG. 4. The outer ornaments 114 and 116 may be slidably motorized by a lead screw motor. For example, FIGS. 8 and 12 show how an outer ornament 114 or 116 is attached to a lead screw block 802 such that the outer ornament 114 may slide when the lead screw 802' turns. Furthermore, FIG. 10 shows that block plates 803 are bolted or attached to the screw block 802. In one embodiment, the block plates 803 surround the block 802 to at least some extent, and in another embodiment the plates 803 encase the screw block 802. The purpose of fixing these plates 803 to the block 802 is to allow the octagons to move with the crystal support frame together back and forth. This is why the lead screw block 802 needs to be firmly attached (e.g. bolted) to the plates 803.

The outer ornaments 114 and 116 sliding causes an inner ornament arm 502 to laterally displace when their connection to a respective slide (e.g. round slide or a slide track 1302) reaches a certain position that forces the inner ornament arm 502 to displace. Since the inner ornament arm 502 is attached to each inner ornament slide track 120, laterally displacing the inner ornament arm 502 causes each inner ornament slide track 120 to extend or retract respectively. For example, FIG. 14 shows how the outer ornament 114 or 116 is attached to a main slide 1302, such that sliding the outer ornament 114 or 116 causes the main slide to extend or retract. The main slide 1302 is attached to the inner ornament arm 502 to allow the motion of the outer ornament 114 or 116 to displace the inner ornament arm 502.

Figure 3:
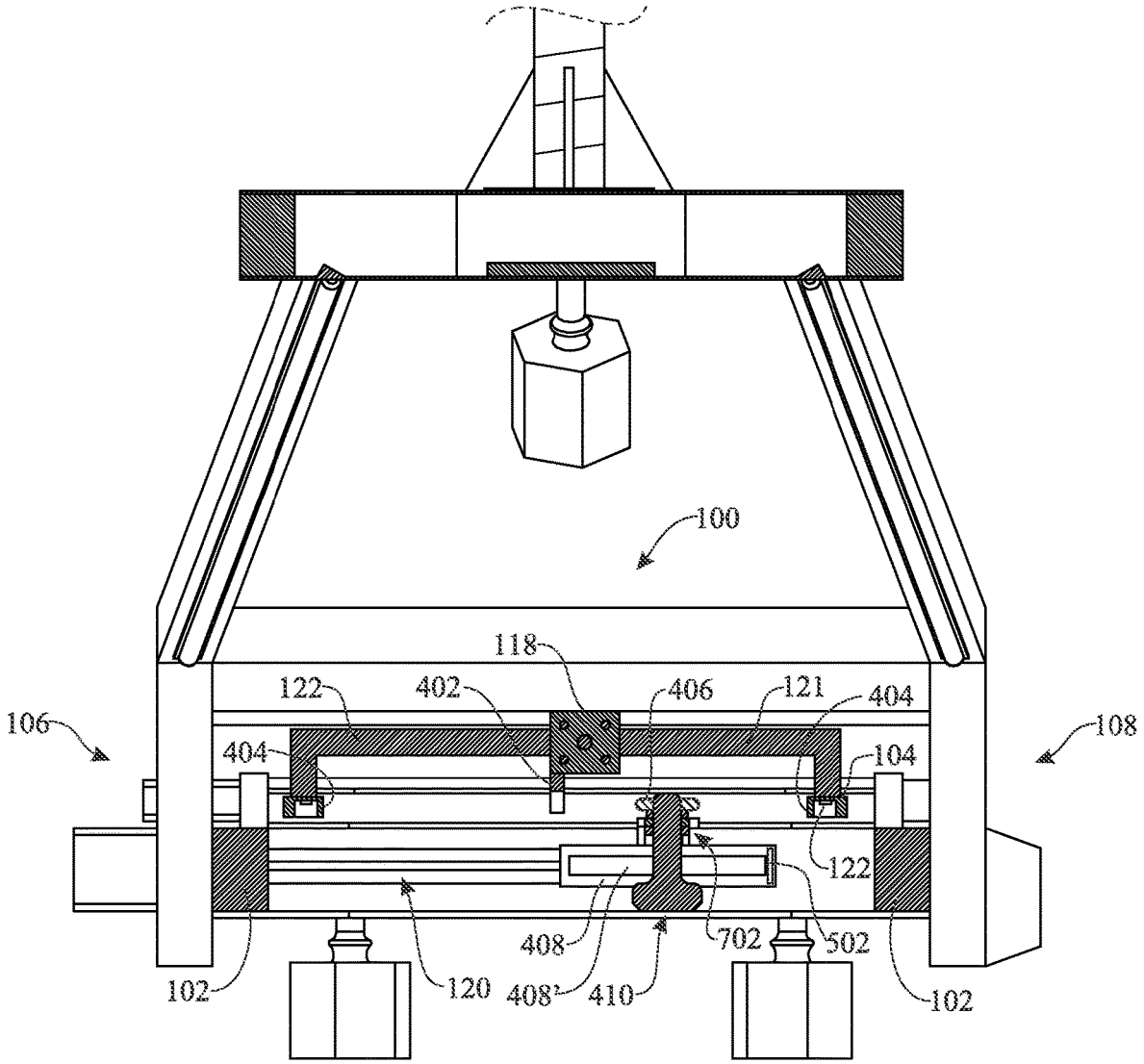
FIG. 3 presents a front cross sectional view, where the cross section is taken along cross sectional plane 3-3 of FIG. 2.
Figure 17:
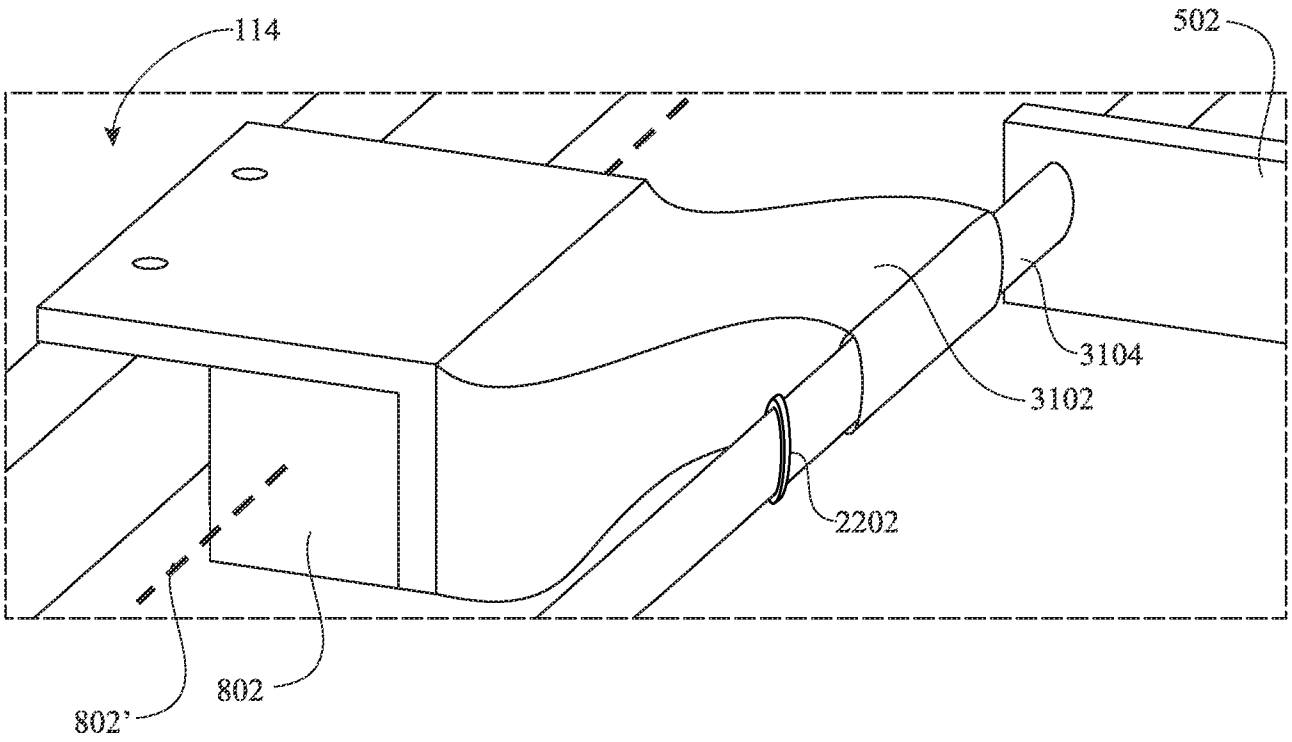
FIG. 17 shows a perspective view of an exemplary main slide arrangement to slide outer ornaments and an inner ornament arm, in accordance with aspects of the present disclosure.
Figure 18:
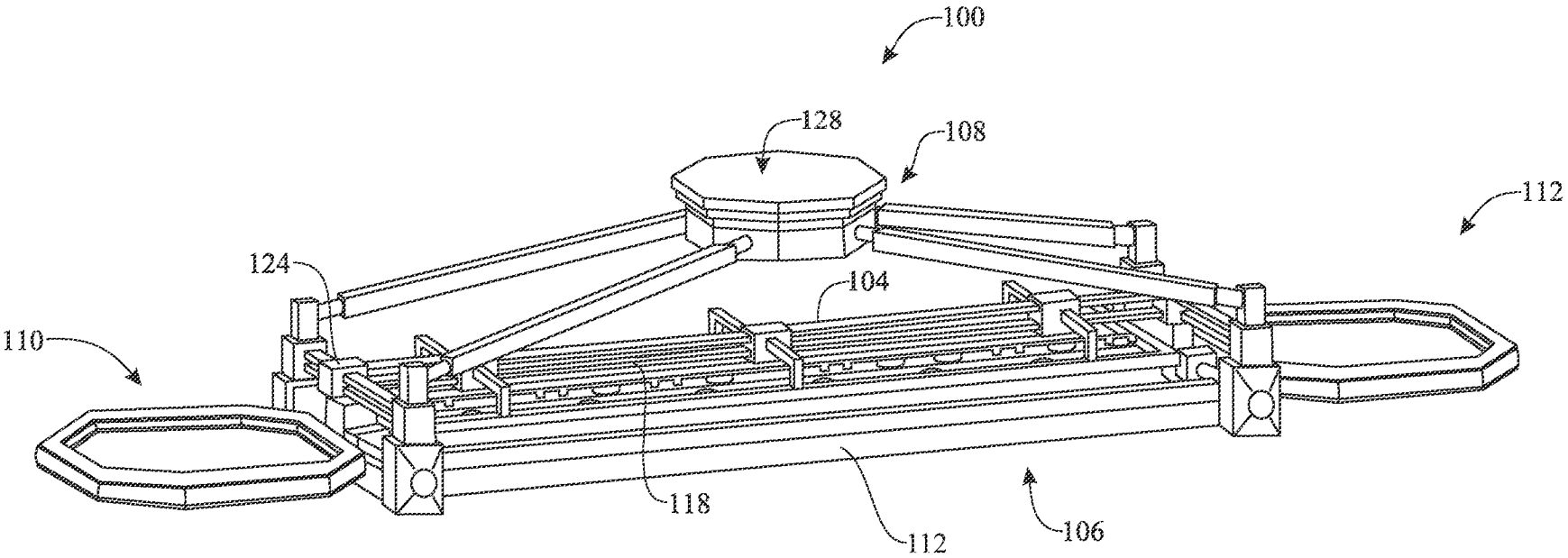
FIGS. 18-24 show various views of an example chandelier, in accordance with aspects of the disclosure.
Figure 19:
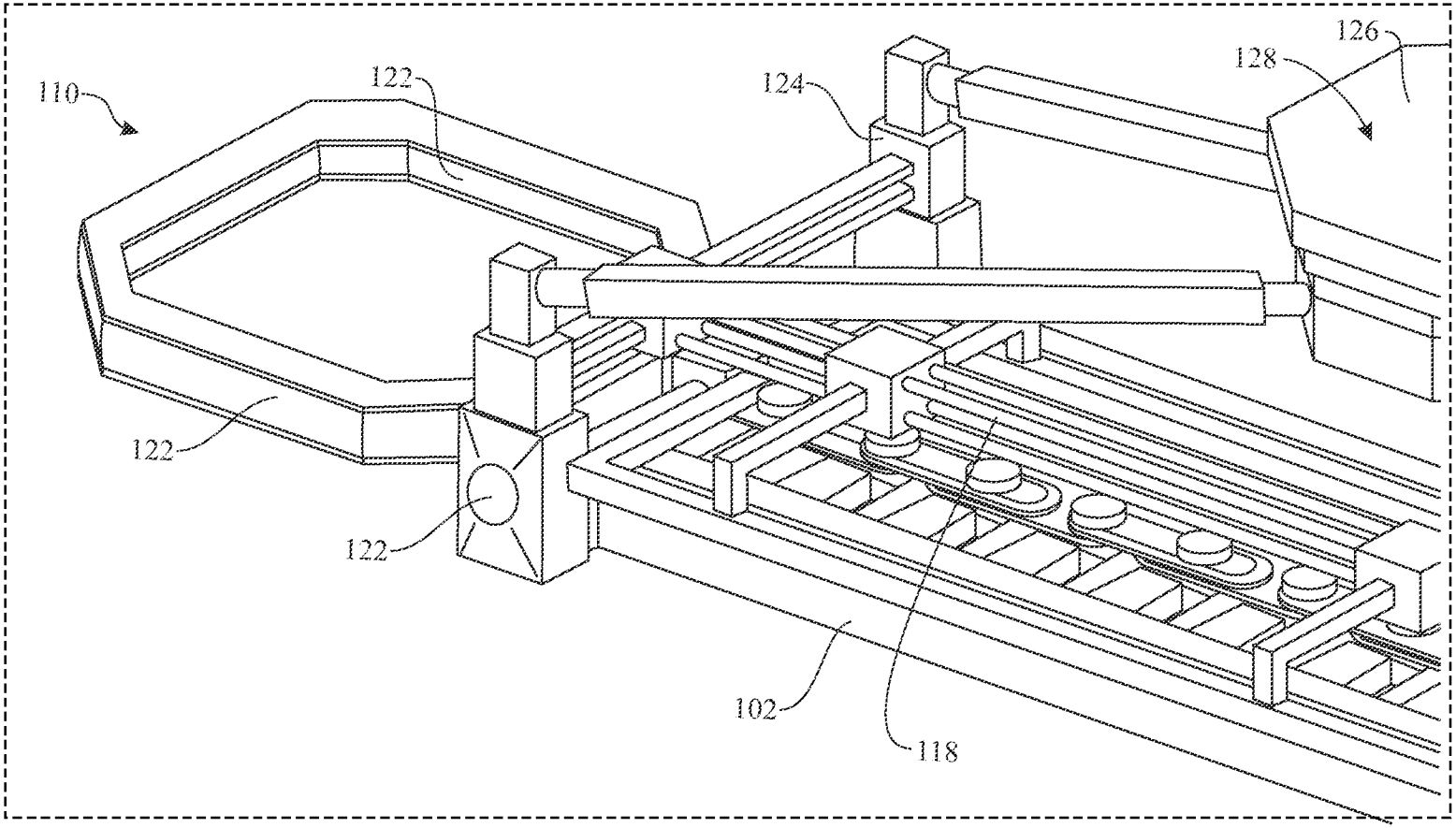
Figure 20:
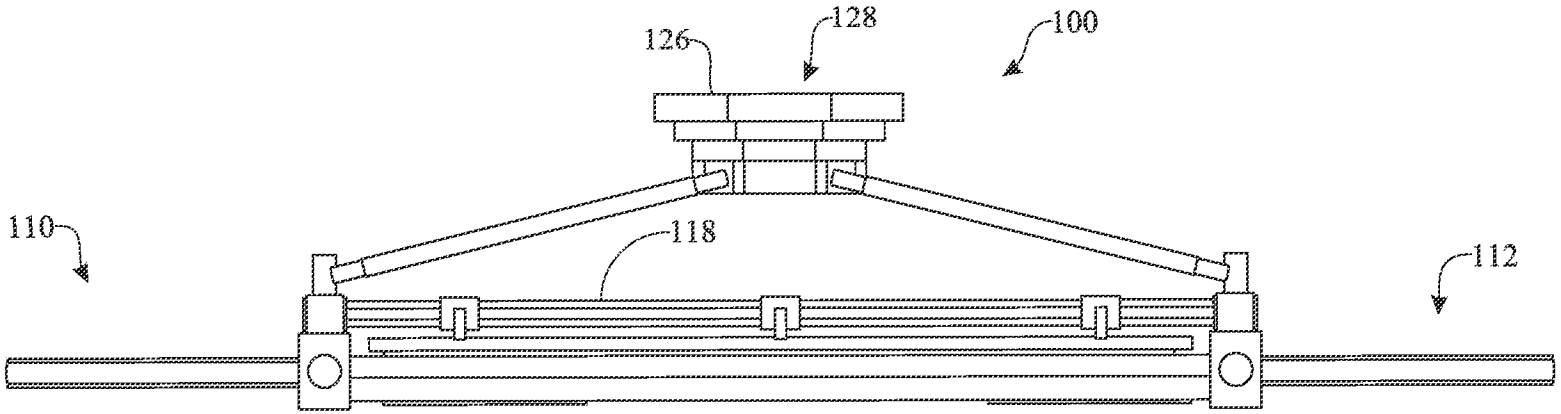

As shown in FIG. 17, another exemplary arrangement of a main slide 1302 is shown, where the lead screw block 802 causes a slide attachment piece 3102 to slide along a main slide bar 3104 when the lead screw 802' is rotated by a motor. Causing the slide attachment piece 3102 to slide along the main slide bar 3104 may cause the inner ornament arm 502 to displace across the bar 3104. To return the inner ornament arm 502, and the inner ornament slides 120 back to a retracted position, the push surface shown in FIG. 3, pushes the inner ornaments 410 back toward a retracted position, causing the inner ornament slide 120 (FIG. 3) to ultimately retract when the inner ornament 410 reaches a left side of its attachment point (left side of its channel) on the inner ornament slide 120 (FIG. 3). Therefore, the inner ornament slide 120 may include at least two sliding pieces, where on a distal sliding piece 408 the inner ornament 410 may be slidably attached, and the distal sliding piece has a channel that receives the inner ornament. The main slide 1302 may resemble the inner ornament slides 120 in functionality and structure, and may be reversed such that an attachment point of the outer ornament 114 or 116 may be slidably attached into the main slide 1302.

Figure 11:
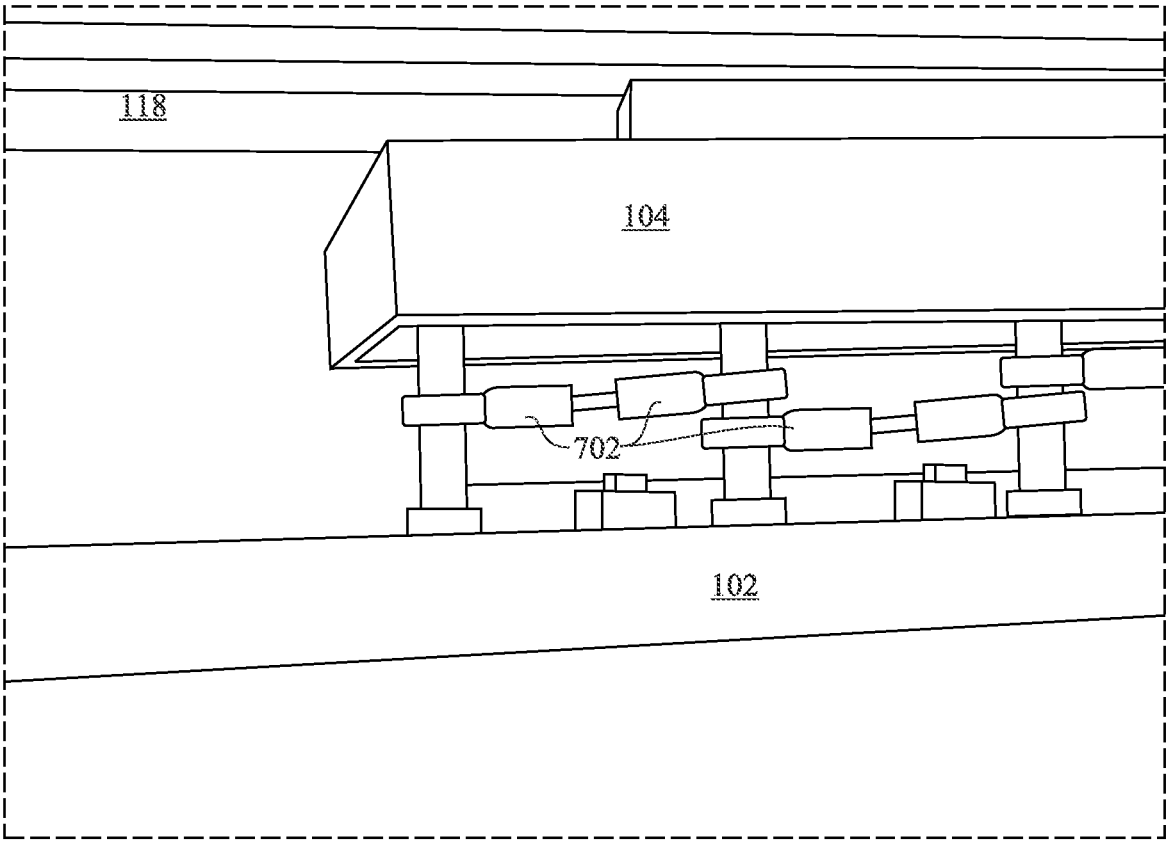
FIG. 11 shows a close-up side elevation view of the chandelier, in accordance with aspects of the present disclosure.

As shown in FIG. 11, the inner ornaments 410 may be pivotably attached to one another via links 702. Such links 702 allow the inner ornaments to be placed in a variety of positions, by motioning the herein described elements.

The illustration of FIG. 6 shows an exemplary pattern that may be created due to the upper frame translating laterally. The push structures 402 which can more clearly be seen in FIGS. 3 and 8 cause certain inner ornaments to translate, and by motioning the push structures longitudinally via translating the arm 118 longitudinally, the push structures may be aligned with different inner ornaments, and subsequently different ornaments may be pushed via laterally translating the arm 118. It is to be understood that these motions may be used to push the inner ornaments into any appropriate configuration. To bring the inner ornaments back into a straight line, the push surface 404 may be brought back toward the starting position of FIG. 4 to push the freely sliding inner ornaments into a straight line.

Although the structure 404 puts the crystals in a straight line, it is to be understood that this is correct but not in a starting position. Element 404 only pushes the crystals to the left (at the rear) of the slide track 108 back in a straight line. Slide track 408 brings all the crystals in a straight line to the center of the frame to a starting position. Element 408 puts all the crystals in the starting position when the crystal slide track 408 is fully extended.

Figure 22:
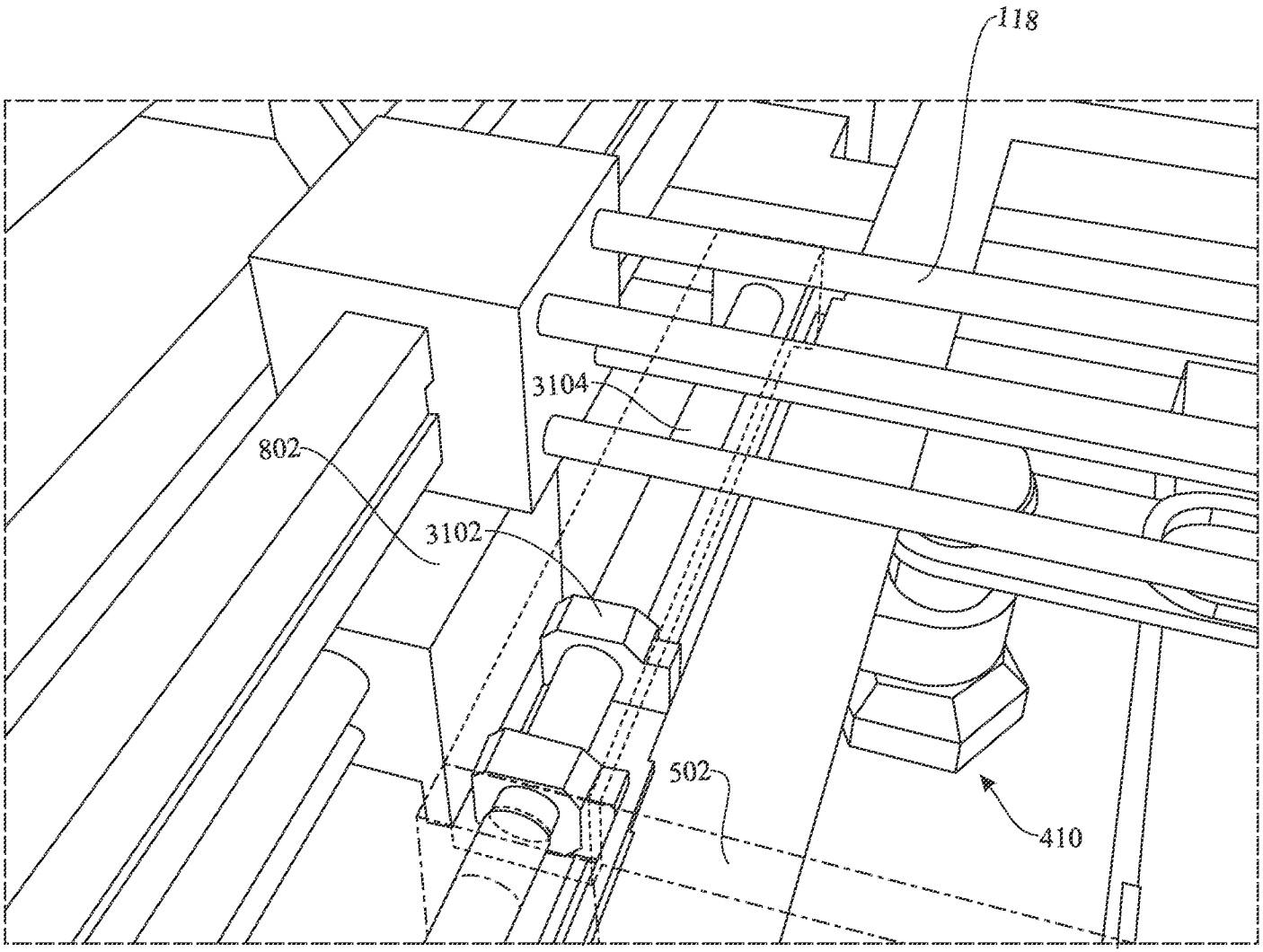
Figure 23:
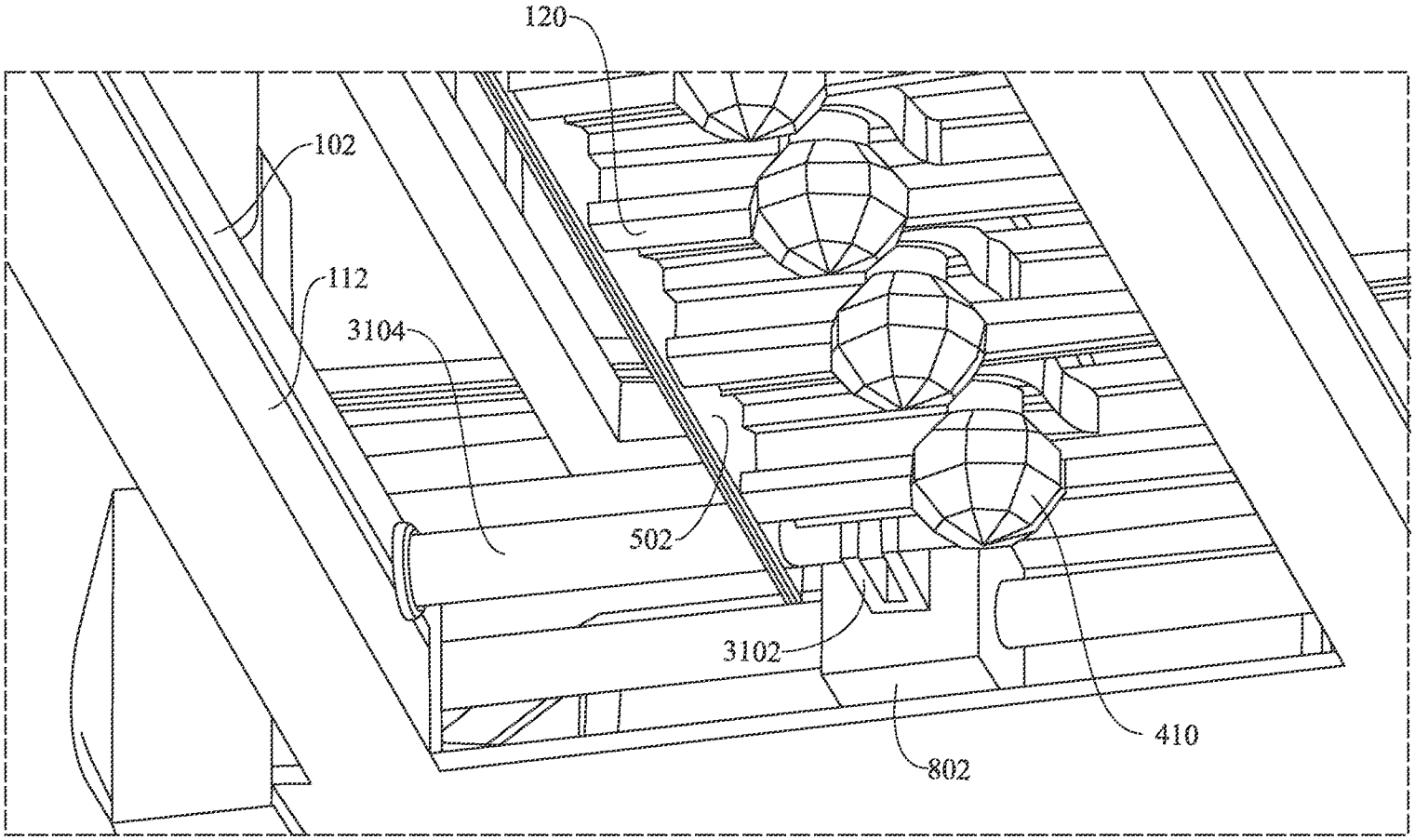
Figure 24:
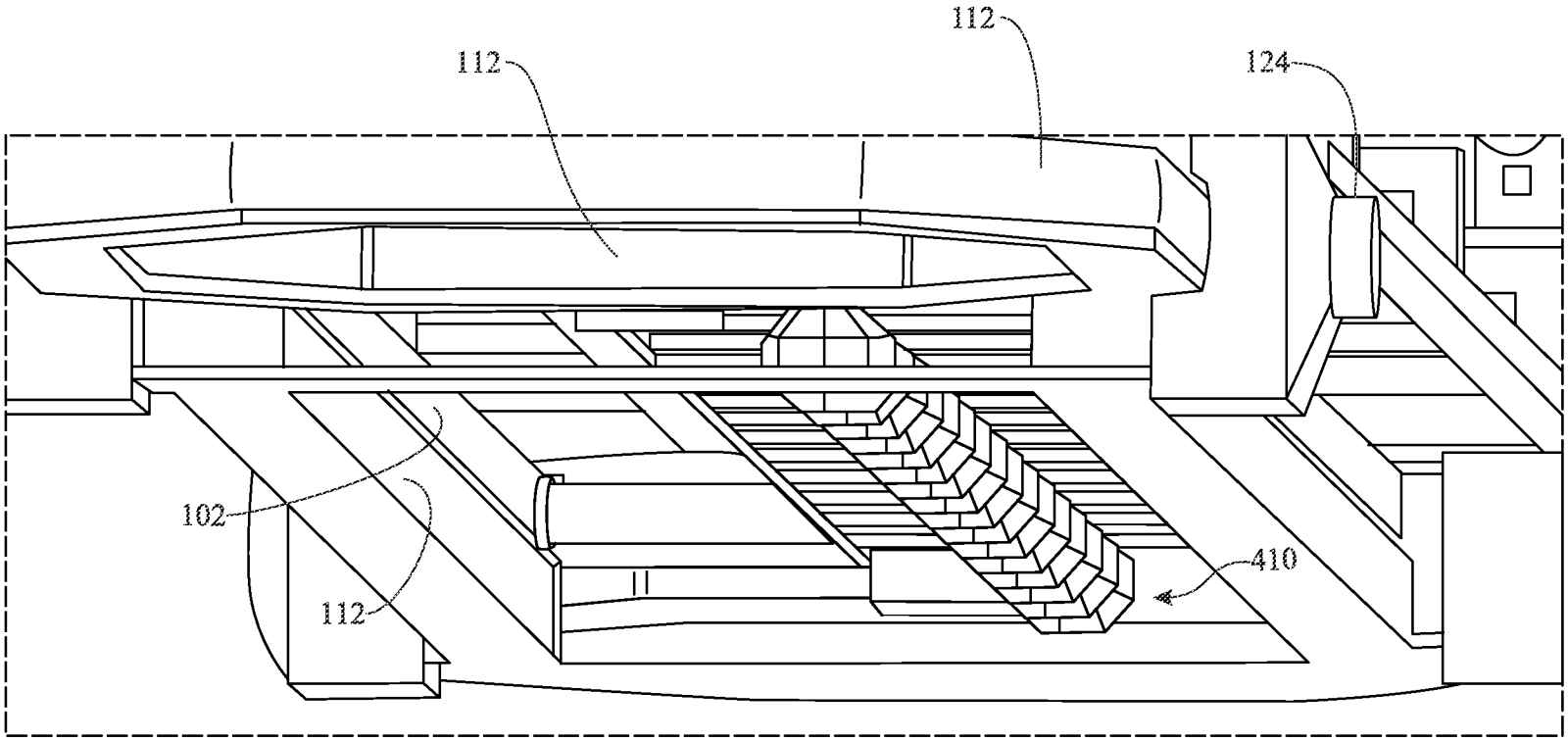

The illustration of FIG. 22 shows an structural element 2202 that allows the slide tracks to telescope outwards, fully extended and placing the crystals in a straight line. As such, the structural element 2202 may be a telescoping piece of the slide track that extends and retracts to push the crystals in a straight line.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A chandelier, the chandelier comprising:

a lower frame and an upper frame;

a first side and a second side opposite from each other;

a third side and a fourth side opposite from each other and adjacent the first side and second side;

a first outer ornament attached on the third side;

a second outer ornament attached on the fourth side;

wherein the first outer ornament and the second outer ornament selectively slide along the third side and fourth side respectively;

a plurality of inner ornaments attached within the sides of the lower frame, such that the plurality of inner ornaments selectively displace within the sides of the lower frame;

wherein the chandelier further comprises: a push arm slidably attached between the third side and the fourth side to cause the inner ornaments to selectively displace; and wherein the push arm includes intermittently arranged downwardly oriented push structures configured to push some of the plurality of inner ornaments when the push arm slides.

2. The chandelier of claim 1, wherein the push structures are configured to push some of the inner ornaments to create a pattern using the inner ornaments.

3. The chandelier of claim 1, wherein each inner ornament is slidably attached to an inner ornament slide track.

4. The chandelier of claim 3, wherein the inner ornament slide track telescopes.

5. The chandelier of claim 3, wherein the inner ornament slide tracks are attached to an inner ornament arm extending between the third side and the fourth side.

6. The chandelier of claim 5, wherein the inner ornament arm is configured to slide along the third side and fourth side.

7. The chandelier of claim 6, wherein sliding the inner ornament arm causes the inner ornament slide tracks to extend and retract.

8. The chandelier of claim 5, wherein sliding the first outer ornament and second outer ornament causes the inner ornament arm to slide.

9. The chandelier of claim 1, wherein the upper frame includes a push surface extending along the second side configured for pushing all of the inner ornaments into a straight line.

10. The chandelier of claim 1, wherein the push arm is configured to displace longitudinally to adjust alignment between the push structures and the inner ornaments, such that different inner ornaments are pushable to create various patterns.

11. The chandelier of claim 1, wherein one or more motors are included to cause the push arm and/or the upper frame to slide laterally.

12. The chandelier of claim 1, wherein the push arm is fixed to the upper frame, and the upper frame and the push arm slide together to cause the inner ornaments to be selectively pushed.

13. The chandelier of claim 1, wherein the chandelier includes one or more of lights and mirrored surfaces.

14. The chandelier of claim 1, wherein one or more motors are included to cause the outer ornaments to slide.

15. The chandelier of claim 14, wherein a computer is included to instruct the motors to cause the outer ornaments, the upper frame, and the push arm to slide.

16. The chandelier of claim 1, wherein one or more motors are included to cause the push arm to slide longitudinally.

17. A chandelier, the chandelier comprising: a lower frame and an upper frame;

a first side and a second side opposite from each other;

a third side and a fourth side opposite from each other and adjacent the first side and second side;

a first outer ornament attached on the third side;

a second outer ornament attached on the fourth side;

wherein the first outer ornament and the second outer ornament selectively slide along the third side and fourth side respectively;

a plurality of inner ornaments attached within the sides of the lower frame, such that the plurality of inner ornaments selectively displace within the sides of the lower frame, and wherein the chandelier further comprises:

a push arm slidably attached between the third side and the fourth side to cause the inner ornaments to selectively displace.

18. A chandelier, the chandelier comprising:

a lower frame and an upper frame;

a first side and a second side opposite from each other;

a third side and a fourth side opposite from each other and adjacent the first side and second side;

a first outer ornament attached on the third side;

a second outer ornament attached on the fourth side;

wherein the first outer ornament and the second outer ornament selectively slide along the third side and fourth side respectively;

a plurality of inner ornaments attached within the sides of the lower frame, such that the plurality of inner ornaments selectively displace within the sides of the lower frame; and wherein the chandelier further comprises:

a push arm slidably attached between the third side and the fourth side to cause the inner ornaments to selectively displace; and wherein the push arm includes intermittently arranged downwardly oriented push structures configured to push some of the plurality of inner ornaments when the push arm slides.

* * * * *